US006039015A

United States Patent [19]

Sato

[11] Patent Number: 6,039,015

[45] Date of Patent: Mar. 21, 2000

[54] VALVE TIMING CONTROL DEVICE

[75] Inventor: Atsushi Sato, Brussels, Belgium

[73] Assignee: Aisin Seiki Kabushiki Kaisha, Aichi-pref, Japan

[21] Appl. No.: 09/161,468

[22] Filed: Sep. 28, 1998

[30] Foreign Application Priority Data

Sep. 29, 1997 [JP] Japan ..... 9-264266

[51] Int. Cl.[7] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,775,279 | 7/1998 | Ogawa et al. | 123/90.17 |
| 5,813,378 | 9/1998 | Sato | 123/90.17 |

FOREIGN PATENT DOCUMENTS

| | | |
|---|---|---|
| 9-60508 | 3/1997 | Japan . |
| 10-47022 | 2/1998 | Japan . |
| 2302391 | 1/1997 | United Kingdom . |

*Primary Examiner*—Weilun Lo
*Attorney, Agent, or Firm*—Reed Smith Hazel & Thomas LLP

[57] ABSTRACT

A valve timing control device comprising a cam shaft rotatably assembled within an engine; a rotational transmitting member mounted around the peripheral surface of the cam shaft so as to rotate relative thereto within a predetermined range for transmitting a rotational power from a crank pulley; vanes provided on the cam shaft or the rotational transmitting member; fluid chambers formed between the cam shaft and the rotational transmitting member and separated into advancing chambers and delaying chambers by the vanes; a first fluid passage for feeding and discharging a fluid to and from the advancing chambers; a second fluid passage for feeding and discharging a fluid to and from the delaying chambers; a retracting bore formed in the rotational transmitting member and accommodating a locking pin and a spring to act on the locking pin; a plate supporting one end of the spring, the plate engaging with a groove which penetrates in the radial direction of the retracting bore; a receiving bore formed on the cam shaft; and a third fluid passage for feeding to the receiving bore.

3 Claims, 3 Drawing Sheets

VALVE TIMING CONTROL DEVICE

FIELD OF THE INVENTION

The present invention relates to a valve timing control device and, in particular, to the valve timing control device for controlling an angular phase difference between a crank shaft of a combustion engine and a cam shaft of the combustion engine.

BACKGROUND OF THE INVENTION

A conventional device of this kind is disclosed, for example, in U.S. Pat. No. 4,858,572. This device includes a cam shaft rotatably assembled with a cylinder head of an engine; a rotational transmitting member mounted around the peripheral surface of the cam shaft so as to rotate relative thereto within a predetermined range for transmitting a rotational power from a crank pulley; a plurality of vanes provided on the cam shaft or the rotational transmitting member; fluid chambers formed between the cam shaft and the rotational transmitting member and separated into advancing chambers and delaying chambers by the vanes; a first fluid passage for feeding and discharging a fluid to and from the advancing chambers; a second fluid passage for feeding and discharging a fluid to and from the delaying chambers; a retracting bore formed in the rotational transmitting member and accommodating a locking pin and a spring to act on the locking pin; a receiving bore formed on the cam shaft; and a third fluid passage for feeding to the receiving bore.

In the above device, both the retracting bore and the receiving bore are formed in the radial reduction of the cam shaft. There is a stop member which is located at the outer end of the retracting bore. The stop member is tightly pressed into the retracting bore to support one end of the spring. When the stop member is pressed, the stop member shaves the inside surface of the retracting bore such that the shaving grounds are disposed between the outer surface of the locking pin and the inner surface of the retracting bore. Thus, the locking pin is not able to slide smoothly. The problem is avoided by shaving the inside surface of the retracting bore, when the pressed area of the stop member decreases. However, the strength of the press decreases such that the stop member is dropped out from the retracting bore.

On the other hand, there is another type of the device whose retracting bore includes a ring groove on the inner surface thereof so as to engage with a snap ring. The snap ring supports one end of the spring. However, in the above structure, to make the ring groove is very difficult and to engage the snap ring with the ring groove is very difficult. Thereby, the manufacturing cost of the device becomes expensive.

SUMMARY OF THE INVENTION

Accordingly, it is an object of the present invention to provide an improved valve timing control device without the foregoing drawbacks.

In accordance with the present invention, a valve timing control device comprising: a cam shaft rotatably assembled with a cylinder head of an engine; a rotational transmitting member mounted around the peripheral surface of the cam shaft so as to rotate relative thereto within a predetermined range for transmitting a rotational power from a crank pulley; a plurality of vanes provided on the cam shaft or the rotational transmitting member; fluid chambers formed between the cam shaft and the rotational transmitting member and separated into advancing chambers and delaying chambers by the vanes; a first fluid passage for feeding and discharging a fluid to and from the advancing chambers; a second fluid passage for feeding and discharging a fluid to and from the delaying chambers; a retracting bore formed in the rotational transmitting member and accommodating a locking pin and a spring to act to the locking pin; a plate supporting the one end of the spring, the plate engaging with a groove which penetrates in the radial direction of the retracting bore; a receiving bore formed on the cam shaft; and a third fluid passage for feeding to the receiving bore.

Other objects and advantages of invention will become apparent during the following discussion of the accompanying drawings.

BRIEF DESCRIPTION OF THE DRAWINGS

The foregoing and additional features of the present invention will become more apparent from the following detailed description of preferred embodinments thereof when considered with reference to the attached drawings, in which.

DETAILED DESCRIPTION OF THE PREFERRED EMBODIMENTS

A valve timing control device in accordance with preferred embodiments of the present invention will be described with reference to the attached drawings.

Figure 1:
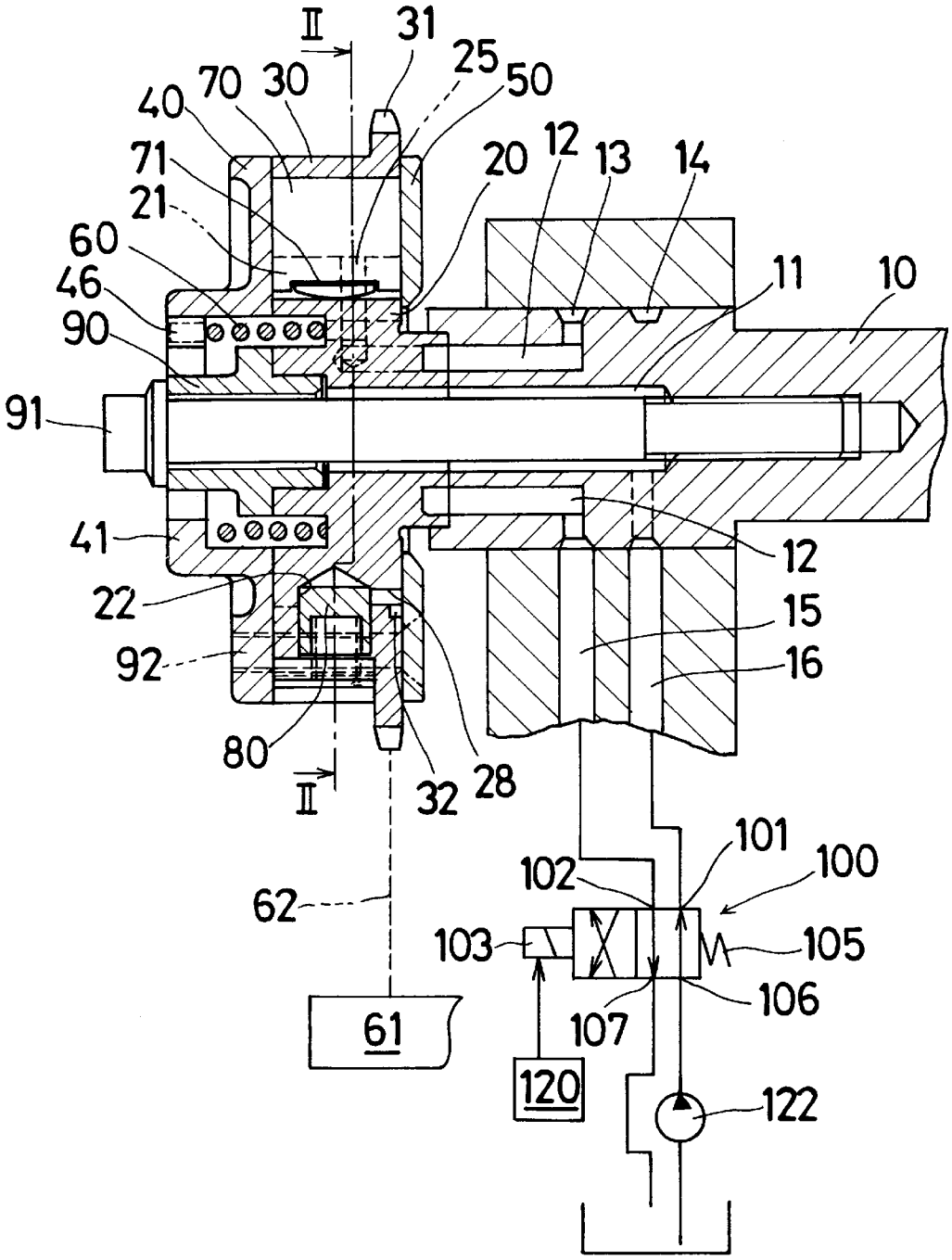
FIG. 1 is a sectional view of the preferred embodiment of a valve timing control divide in accordance with the present invention.
Figure 2:
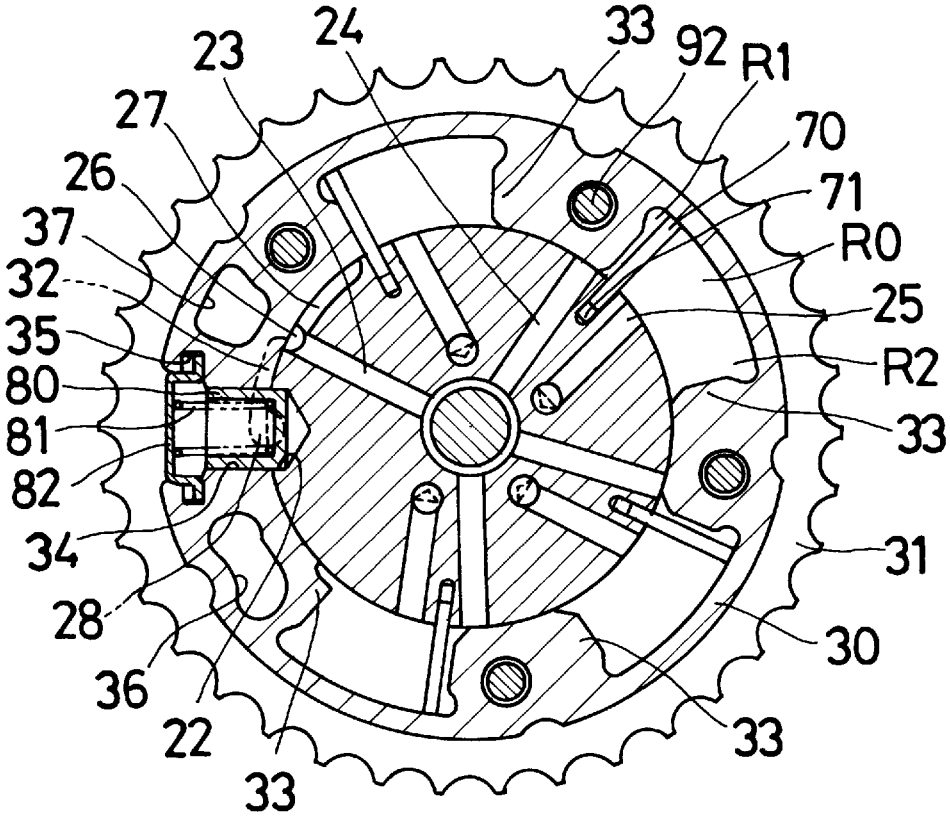
FIG. 2 is a section taken along the line II—II in FIG. 1 in accordance with the present invention.

A valve timing control device according to the present invention, as shown in FIGS. 1 and 2, is constructed so as to comprise a valve opening/closing shaft including a cam shaft 10 rotatably supported by a cylinder head 110 of an internal combustion engine, and a rotary shaft which has an internal rotor 20 integrally provided on the leading end portion of the cam shaft 10; a rotational transmitting member mounted around the rotary shaft so as to rotate relative thereto within a predetermined range and including an external rotor 30, a front plate 40, a rear plate 50 and a timing sprocket 31 which is integrally formed around the external rotor 30; a torsion spring 60 which disposed between the internal rotor 20 and the front plate 40; four vanes 70 assembled with the internal rotor 20; and a locking pin 80 which is assembled with the external rotor 30. Here, the timing sprocket 31 is constructed, as is well known in the art, to transmit the rotating power to the clockwise direction of FIG. 2 from a crank pulley 61 through a timing belt 62 of a resin or a rubber shown in FIG. 1.

The cam shaft 10 is equipped with the well-known cam (although not shown) for opening/closing an intake valve or an exhaust valve (although not shown) and is provided therein with an advance passage 11 and a delay passage 12, which are extended in the axial direction of the cam shaft 10. The advance passage 11 is connected to a connection port 101 of a change-over valve 100 via an annular passage 14 and a connection passage 16. On the other hand, the delay passage 12 is connected to a connection port 102 of the change-over valve 100 via an annular passage 13 and a connection passage 15.

The change-over valve 100 is under the control of a controller 120 which is in the form of a micro-processor. The change-over valve 100 is so constructed as to establish, when deenergized, the communication between a feed port 106, as connected to an oil pump 120 to be driven by the internal combustion engine, and the connection port 101 and the communication between the connection port 102 and exhaust port 107 and as to establish, when energized, the communication between the feed port 106 and the connection port 102 and the communication between the connection port 101 and an exhaust port 108. As a result, the working oil is fed to the advance passage 11, when the solenoid 103 is deenergized, and to the delay passage 12 when the same is energized.

The internal rotor 20 is integrally fixed in the cam shaft 10 via a spacer 91 by means of a bolt 91 and is provided with four axial grooves 21 for providing the four vanes 70 individually in the radial directions. Further, the internal rotor 20 is provided with a receiving bore 22 into which a head portion of a locking pin 80 is fitted by a predetermined amount when the relative phase between the internal rotor 20 and the external rotor 30 is a predetermined phase (the maximum retarded condition) shown in FIG. 2; a passage 23, which is connected to the advance passage 11, for feeding/discharging the working oil to and from the receiving bore 22; passages 24, which are connected to the advance passage 11, for feeding/discharging the working oil to and from advancing chambers R1; and passages 25, which are connected to the delay passage 12, for feeding/discharging the working oil to and from delaying chambers R2. Here, each vane 70 is urged radially outward by a spring 71 (as shown in FIG. 1) fitted in the bottom portion of the vane groove 21. An advancing chamber R1*a* is fed the working oil via a passage 27 which is disposed on the outer circumference of the internal rotor 20. Further, an axial groove 28 is formed on the outer circumferential surface of the internal rotor 20 so as to be extended from the opening end of the receiving bore 22 toward the rear plate 50. An axial groove 26 is formed on the outer circumferential surface of the internal rotor 20 so as to be extended from the opening end of the passage 23 toward the rear plate 50. These axial grooves 26 and 28 are communicated with each other via a groove 32 which is formed on the rear side surface of the external rotor 30 at the maximum retarded condition shown in FIG. 2. Therefore, the receiving bore 22 is communicated to the advance passage 11 via the axial groove ~28, the groove 32, the axial groove 26 and the passage 23 only when the relative phase between the internal rotor 20 and the external rotor 30 is the maximum retarded condition.

The external rotor 30 is mounted on the outer circumference of the internal rotor 20 so as to be able to rotate a predetermined amount relative to the internal rotor 20. As shown in FIG. 1, the front plate 40 and the rear plate 50 are fluid-tightly connected on both sides of the external rotor 30, and the front plate 40, the rear plate 50 and the external rotor 30 are fastened by bolts 92. The timing sprocket 31 is integrally formed on the outer circumference of the rear end of the external rotor 30. Further, four projecting portions 33 which are projected inwardly are formed on the inner circumferential portion of the external rotor 30. The inner circumferential surface of each of the projecting portions 33 is slidably mounted on the internal rotor 20. A retracting bore 34 in which the locking pin 80 and a spring 81 are disposed is formed in one of the projecting portions 33 and hollow portions 36, 37 are formed in this projecting portion 33.

The front plate 40 is a circular plate having a tubular portion 41 and communicating holes (not shown) which correspond to the hollow portions 36, 37 formed therein. The front plate 40 is provided with a notch portion 46 with which one end of the torsion spring 60 is engaged. The rear plate 50 is a circular plate and is provided with communicating holes (not shown) which correspond to the hollow portions 36 and 37.

The torsion spring 60 is engaged with the internal rotor 20 at its the outer end and urges the internal rotor 20 relative to the external rotor 30, the front plate 40 and the rear plate 50 clockwise in FIG. 2. The torsion spring 60 is provided considering the force which obstructs the rotation of the internal rotor 20 and the vanes 70 toward the advance side. The torsion spring 60 urges the internal rotor 20 relative to the external rotor 30, the front plate 40 and tile rear plate 50 toward the advance side and thereby the response of the rotation of the internal rotor 20 toward the advance side is improved.

Each of vanes 70 is disposed in each of pressure chambers RO formed between the adjacent projecting portions 33 and divides the pressure chamber RO into the advancing chamber R1 and the delaying chamber R2.

Figure 3:
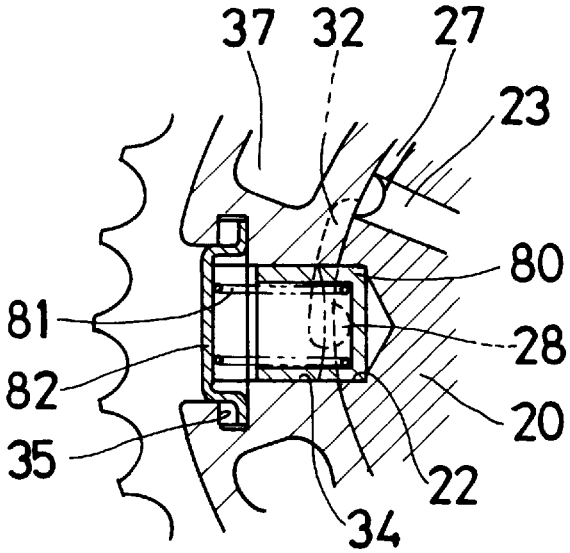
FIG. 3 is a detail view, on an enlarged scale, of a locking pin shown in FIG. 2 in accordance with the present invention.
Figure 4:
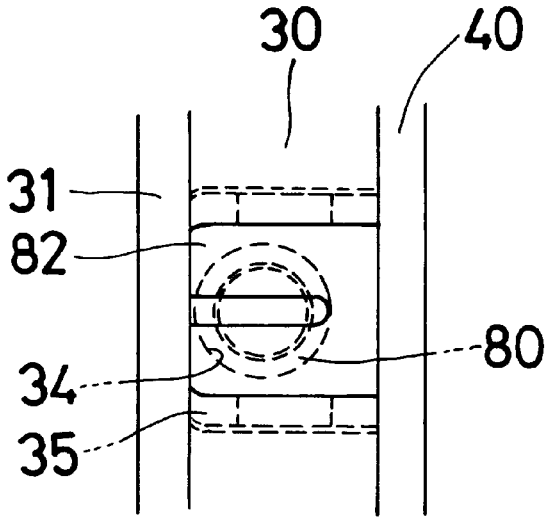
FIG. 4 is a side elevation view in FIG. 3 in accordance with the present invention.
Figure 5:
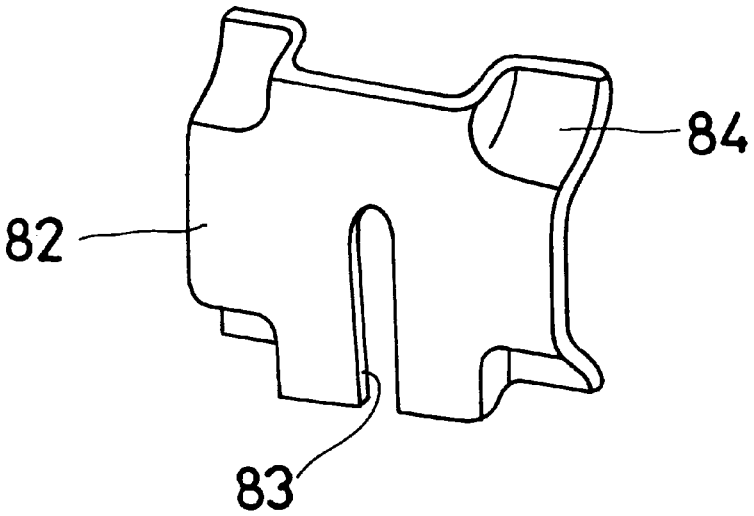
FIG. 5 is a perspective view of a plate shown in FIG. 1 in accordance with the present invention.

The locking pin 80 is fitted in the retracting bore 34 so as to be able to move in the radial direction of the external rotor 30 and is urged toward the internal rotor 20 by the spring 81 which is disposed between the locking pin 80 and a retainer 82. In this embodiment, as shown in FIGS. 3 and 4, a groove 35 which penetrates the retracting bore 34 at the outer end of the retracting bore 34 and whose one end is opened into the front side surface of the external rotor 30 is formed on the external rotor 30. The plate-shaped retainer 82, as shown in FIG. 5, is fitted into the groove 35 from the front side surface side of the external rotor 30 and the one end of the spring 81 is engaged with the retainer 82. The retainer 82 includes four projections 84. Each projection 84 is located at the corner portions of the retainer 82 so as to engage with the groove 35 of the retracting bore 34. Here, the retainer 82 has a long hole 83 as shown FIG. 4 and 5.

In the embodiment, while the engine is at rest, the oil pump 122 also remains non-operational and the changeover valve 100 is in the condition shown in FIG. 1. Further, the head of the locking pin 80 is inserted into the receiving bore 22 so as to lock the relative phase between the internal rotor 20 and the external rotor 30 at the maximum retarded condition under which the volume of the each of the delaying chambers R2 becomes a maximum valve, and the oil under pressure is not supplied to the advance passage 11 and the delay passage 12. Accordingly, when the engine is started, unnecessary relative rotation between the rotational shaft comprising the cam shaft 10, the internal rotor 20, the vanes 70 and so on and the rotational transmitting member comprising the external rotor 30, the timing sprocket 31, the front plate 40, the rear plate 50 and so on due to the large rotational variation is regulated, and the drawback due to the unnecessary relative rotation between the rotational shaft and the rotational transmitting member (for example, collision noise by the vanes 70) is avoided.

Further, when the oil pump 122 is driven by the engine and the changeover valve 100 is charted over, the oil is supplied from the oil pump 122 to the advancing chambers R1 via advance passage 11 and the passages 24; and the oil is fed from the delaying chambers R2 via the passages 25 and the delay passage 12. At the same time, the oil is supplied from the oil pump 122 to the advancing chamber R1*a* via advance passage 11, the passage 23 and the passage 27 and to the receiving bore 22 via advance passage 11, the passage 23, the axial groove 26, the groove 32 and the axial groove 28. Thereby, the head portion of the locking pin 80 moves into the retracting bore 34 from the receiving bore 22 against the action of the spring 81 so as to avoid locking the relative phase between the internal rotor 20 and the external rotor 30 such that the rotational shaft comprising the cam shaft 10, the internal rotor 20, the vanes 70 and so on rotates in the advancing direction (the clockwise direction of FIG. 2). Here, after rotating the rotational shaft in a predetermined range, the communication between the passage 23 and receiving bore 22 is held up such that the vibration of the locking pin 80 is stopped by the pulsation of the oil.

In the condition when the head portion of the locking pin 80 is not inserted in the receiving bore 22 and the changeover valve 100 is not changed over, the oil is supplied from the oil pump 122 to the delaying chambers R2 via delay passage 12 and the passages 23; and the oil is fed from the advancing chambers R2 via the passages 24 and the advance passage 11. Thereby, the rotational shaft comprising the cam shaft 10, the internal rotor 20, the vanes 70 and so on rotates in the delaying direction. (the counterclockwise direction of FIG. 2).

In this embodiment, the groove 35 which penetrates the retracting bore 34 at the outer end of the retracting bore 34 and whose one end is opened into the front side surface of the external rotor 30 is formed on the external rotor 30. Accordingly, assembling the device is easy. In particular, after the plate-shaped retainer 82 is inserted into the groove 35 from the front side surface of the external rotor 30, both the side surfaces are fitted by the front plate 40 and the rear plate 50, respectively.

What is claimed is:

1. A valve timing control device comprising:

a cam shaft rotatably assembled with a cylinder head of an engine;

a rotational transmitting member mounted around the peripheral surface of the cam shaft so as to rotate relative thereto within a predetermined range for transmitting a rotational power from a crank pulley;

a plurality of vanes provided on the cam shaft or the rotational transmitting member;

fluid chambers formed between the cam shaft and the rotational transmitting member and separated into advancing chambers and delaying chambers by the vanes;

a first fluid passage for feeding and discharging a fluid to and from the advancing chambers;

a second fluid passage for feeding and discharging a fluid to and from the delaying chambers;

a retracting bore formed in the rotational transmitting member and accommodating a locking pin and a spring to act to the locking pin;

a plate supporting one end of the spring, the plate engaging with a groove which penetrates in the radial direction of the retracting bore;

a receiving bore formed on the cam shaft; and a third fluid passage for feeding to the receiving bore, wherein the rotational transmitting member includes an external rotor having the retracting bore and a plate member which is connected to the external rotor; and the groove has an opening at a connecting portion between the external rotor and the plate member such that the plate member prevents the plate from coming out after the plate is inserted in the groove.

2. A valve timing control device as claimed in claim 1, wherein the plate member includes a front plate and a rear plate, and the external rotor is disposed between the front plate and the rear plate.

3. A valve timing control device as claimed in claim 2, wherein the groove penetrates to the end of the external rotor adjacent the front plate.

* * * * *